US012084969B2

(12) United States Patent
Hay

(10) Patent No.: US 12,084,969 B2
(45) Date of Patent: Sep. 10, 2024

(54) DOWNLINK ACKNOWLEDGEMENT METHOD FOR A ROTARY VALVE STEERABLE TOOL

(71) Applicant: Halliburton Energy Services, Inc., Houston, TX (US)

(72) Inventor: Charles Richard Thomas Hay, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 248 days.

(21) Appl. No.: 17/663,884

(22) Filed: May 18, 2022

(65) Prior Publication Data

US 2023/0392446 A1 Dec. 7, 2023

(51) Int. Cl.

| | |
|---|---|
| ***E21B 7/04*** | (2006.01) |
| ***E21B 7/06*** | (2006.01) |
| ***E21B 41/00*** | (2006.01) |
| ***E21B 47/18*** | (2012.01) |

(52) U.S. Cl.

CPC ..... *E21B 7/04* (2013.01); *E21B 41/0085* (2013.01); *E21B 47/18* (2013.01); *E21B 7/06* (2013.01)

(58) Field of Classification Search

CPC ..... E21B 47/12; E21B 47/14; E21B 47/18; E21B 47/20; E21B 47/22; E21B 47/24; E21B 7/04; E21B 7/06; E21B 41/0085

See application file for complete search history.

(56) References Cited

U.S. PATENT DOCUMENTS

| | | | |
|---|---|---|---|
| 9,035,788 | B2 | 5/2015 | Downton et al. |
| 11,293,229 | B2 * | 4/2022 | Nanayakkara ..... E21B 41/0085 |
| 11,808,134 | B2 * | 11/2023 | Wicks ..... E21B 19/008 |
| 2018/0252088 | A1 | 9/2018 | Tilley et al. |
| 2020/0056451 | A1 | 2/2020 | Chambers et al. |
| 2020/0199970 | A1 | 6/2020 | Odegbami |
| 2020/0308928 | A1 | 10/2020 | Chambers et al. |

FOREIGN PATENT DOCUMENTS

| | | |
|---|---|---|
| EP | 3054085 B1 | 8/2018 |

OTHER PUBLICATIONS

The International Search Report and Written Opinion dated Jan. 31, 2023 for PCT Patent Application No. PCT/US2022/072444 filed on May 19, 2022.

* cited by examiner

*Primary Examiner* — Franklin D Balseca
(74) *Attorney, Agent, or Firm* — K&L Gates LLP

(57) ABSTRACT

The present disclosure relates to a rotary steerable tool operable to steer a drill bit for drilling a wellbore. In some embodiments, the rotary steerable tool is operable in an acknowledgment mode to confirm receipt of a downlink transmission by performing a detectable acknowledgement action that continues to rotate the drill bit, but temporarily suspends the steering of the drill bit for a period of time by maintaining the valve motor in a stationary rotational position relative to the valve.

23 Claims, 6 Drawing Sheets

DOWNLINK ACKNOWLEDGEMENT METHOD FOR A ROTARY VALVE STEERABLE TOOL

BACKGROUND

This section is intended to provide relevant contextual information to facilitate a better understanding of the various aspects of the described embodiments. Accordingly, it should be understood that these statements are to be read in this light and not as admissions of prior art.

Directional drilling is commonly used to drill any type of well profile where active control of the well bore trajectory is required to achieve the intended well profile. For example, a directional drilling operation may be conducted when the target pay zone is not directly below or otherwise cannot be reached by drilling straight down from a drilling rig above it.

Directional drilling operations involve varying or controlling the direction of a downhole tool (e.g., a drill bit) in a wellbore to direct the tool towards the desired target destination. Examples of directional drilling systems include point-the-bit rotary steerable drilling systems and push-the-bit rotary steerable drilling systems. In both systems, the drilling direction is changed by repositioning the bit position or angle with respect to the well bore. Point-the-bit technologies control a bend angle of the shaft driving rotation of the bit, which can cause the bit to steer in the direction of the bend. Push-the-bit tools typically use extendable or moveable members, such as so-called pad pushers (i.e., a pad and/or a piston), which push against the wall of the well bore causing a direction change.

Dogleg capability is the ability of a drilling system to make precise and sharp turns in forming a directional well. Higher doglegs increase reservoir exposure and allow improved utilization of well bores where there are lease line limitations. Tool face control is a fundamental factor of dogleg capability. Typically, a higher and more precise degree of tool face control increases dogleg capability.

Certain aspects of some embodiments disclosed herein are set forth below. It should be understood that these aspects are presented merely to provide the reader with a brief summary and with certain examples the disclosure might take and that these aspects are not intended to limit the scope of the disclosure. Indeed, some embodiments within the scope of this disclosure may not be set forth below.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
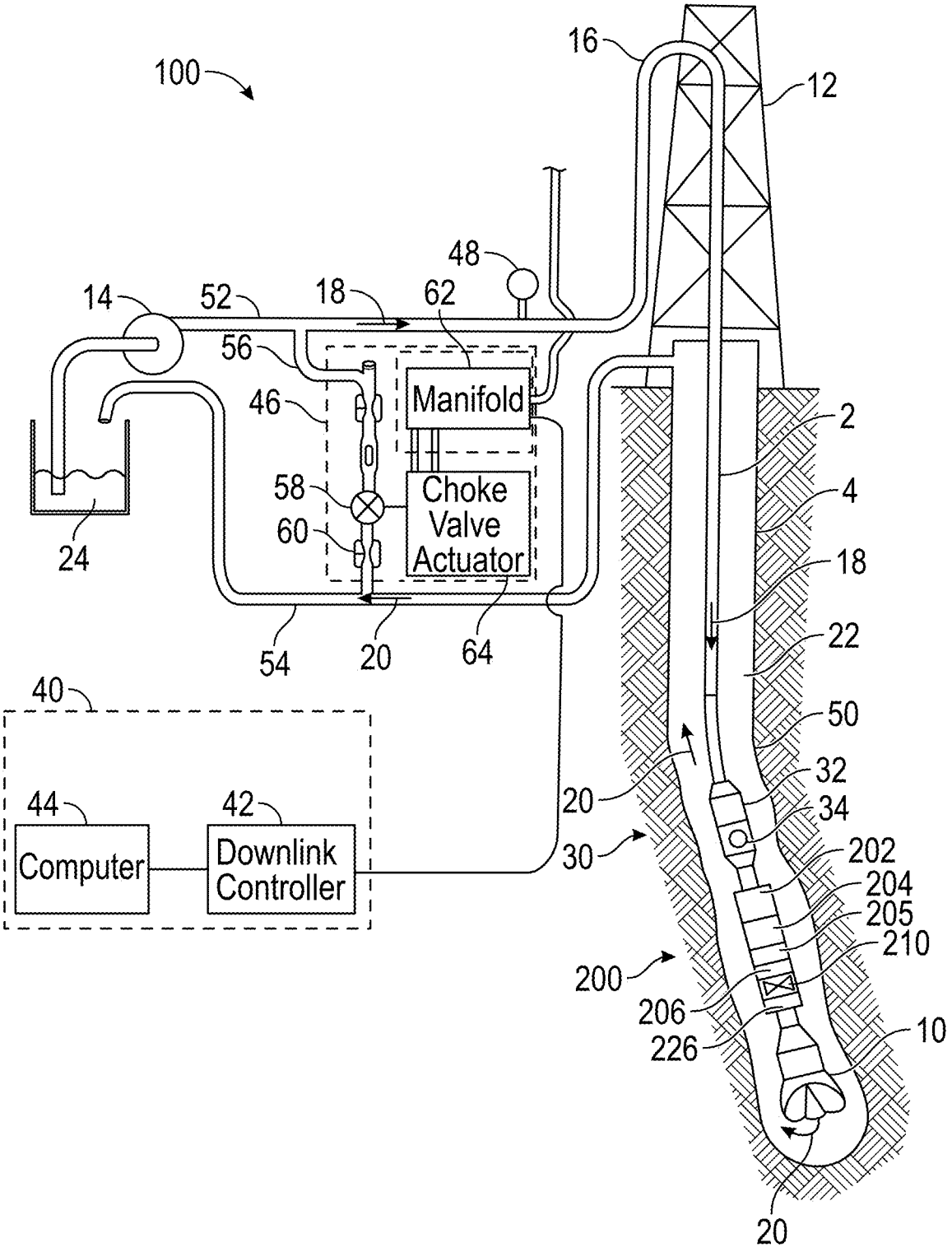
FIG. 1 is a schematic elevation view of a drilling operation utilizing a directional drilling system having a downlink acknowledgement system in accordance with one or more embodiments.

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

A subterranean formation containing oil or gas hydrocarbons may be referred to as a reservoir, and may be located under land or off shore. Reservoirs are typically located in the range of a few hundred feet (shallow reservoirs) to a few tens of thousands of feet (ultra-deep reservoirs). To produce oil or gas or other fluids from the reservoir, a wellbore is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows motive fluids to be introduced into or flowed from a remote portion of the wellbore. In a cased-hole wellbore portion, a casing is placed into the wellbore that can also contain a tubing string. A wellbore can also contain an annulus, such as, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

The system of the present disclosure will be specifically described below such that the system is used to direct a drill bit in drilling a wellbore, such as a subsea well or a land well. Further, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

FIG. 1 shows a schematic elevation view of a directional drilling system 100, including a tool string 2 disposed in a directional wellbore 4. The tool string 2 includes a rotary steerable tool 200. The rotary steerable tool 200 provides directional control of a drill bit 10 in three dimensions (e.g., in the x, y, and z axis in the Cartesian coordinate system). A drilling platform supports a derrick 12 that is used to raise, lower, and rotate the tool string 2 into the directional wellbore 4, more simply referred to herein as the wellbore 4. One having ordinary skill in the art will recognize that other components that are not shown may also be included to support and or rotate the tool string (e.g., a kelly, a rotary table, a topdrive, a traveling block, etc.) The drill bit 10 is positioned at the downhole end of the tool string 2, and may be driven by a downhole motor 202 positioned on the tool string 2 and/or by rotation of the tool string 2 from the surface using the derrick 12.

As the drill bit 10 rotates, the drill bit 10 creates the wellbore 4, as a pump 14 circulates a motive and pressurized drilling fluid (alternatively referred to as drilling mud or simply as mud) through a stand pipe 16 and downhole through the interior of the tool string 2. During drilling operations, the drilling fluid passes along a path 18 through orifices in the drill bit 10, and then flows back along a path 20 to the surface via an annulus 22 around the tool string 2 and into a retention pit 24. The drilling fluid transports cuttings from the wellbore 4 into the retention pit 24 and also aids in maintaining the integrity of the wellbore 4. The drilling fluid may also drive the downhole motor 202 and other portions of the rotary steerable tool 200, such as the extendable members 230 described below.

The tool string 2 may include one or more logging-while-drilling measurement-while-drilling ("LWD/MWD") tools 30 that collect measurements relating to various formation properties of the wellbore 4, the position of the drill bit 10, and various other drilling conditions as the drill bit 10 extends the wellbore 4. The LWD/MWD tool 30 may include a plurality of sensors (such as sensor 34) for measuring formation resistivity, a gamma ray device for measuring formation gamma ray intensity, devices for measuring the inclination and azimuth of the tool string 2, pressure sensors for measuring drilling fluid pressure, pressure sensors for measuring the annulus 22 pressure or flow bore pressure 238, temperature sensors for measuring the wellbore 4 temperature, vibration sensors, acoustic sensors, torque sensors, weight on bit sensors, rotary speed sensors, or combinations thereof. In addition, the LWD/MWD tool 30 may also monitor difference between combinations of sensors 34. For example, the LWD/MWD tool 30 may monitor a pressure difference between the annulus 22 and the flow bore 238.

The LWD/MWD tool 30 may also include a telemetry module 32. The telemetry module 32 receives data provided by the various sensors of the tool string 2 (e.g., sensors of the LWD/MWD tool 30), and transmits the data to a surface control unit 40. Data may also be provided by the surface control unit 40, received by the telemetry module 32, and transmitted to one or more of the tools (e.g., LWD/MWD tool 30, rotary steerable tool 200, etc.) of the tool string 2. However, as described further herein the rotary steerable tool 200 of some embodiments has no data connection with the LWD/MWD tool 30 or with the telemetry module 32. Mud pulse telemetry, wired drill pipe, acoustic telemetry, or other telemetry technologies known in the art may be used to provide communication between the surface control unit 40 and the telemetry module 32 and/or to the rotary steerable tool 200. The surface control unit 40 may communicate directly with the LWD/MWD tool 30 and/or the rotary steerable tool 200. The surface control unit 40 may include a downlink controller 42 coupled to a computer 44. The computer 44 may be positioned at the well site, positioned remotely, or may be distributed between multiple locations and devices. The surface control unit 40 may also be used to control functions of other equipment of the tool string 2 and the directional drilling system 100.

The rotary steerable tool 200 is coupled to the drill bit 10 and is configured to change the orientation and direction of the drill bit 10, in response to controls sent from the surface control unit 40. Generally speaking, an actuator section 226 of the rotary steerable tool 200 selectively pushes against the wall of the wellbore 4 and the drill bit 10 is steered to create a deviation 50 in the wellbore 4. As the drill bit 10 continues to operate, the tool string 2 is curved into a desired well profile as the drill bit 10 advances downhole into the wellbore 4. In the example of FIG. 1, the rotary steerable tool 200 comprises the downhole motor 202 having a turbine that is rotated by drilling fluid flowing through the flow bore 238. The turbine then imparts a rotation to a shaft 203 that is coupled to the power generator 204 to generate electric power for the RSS tool electrical/electronic elements, a downlink receiver 205, a rotary steerable system controller 206 ("RSS controller 206"), a valve 210, and the actuator section 226.

Figure 2:
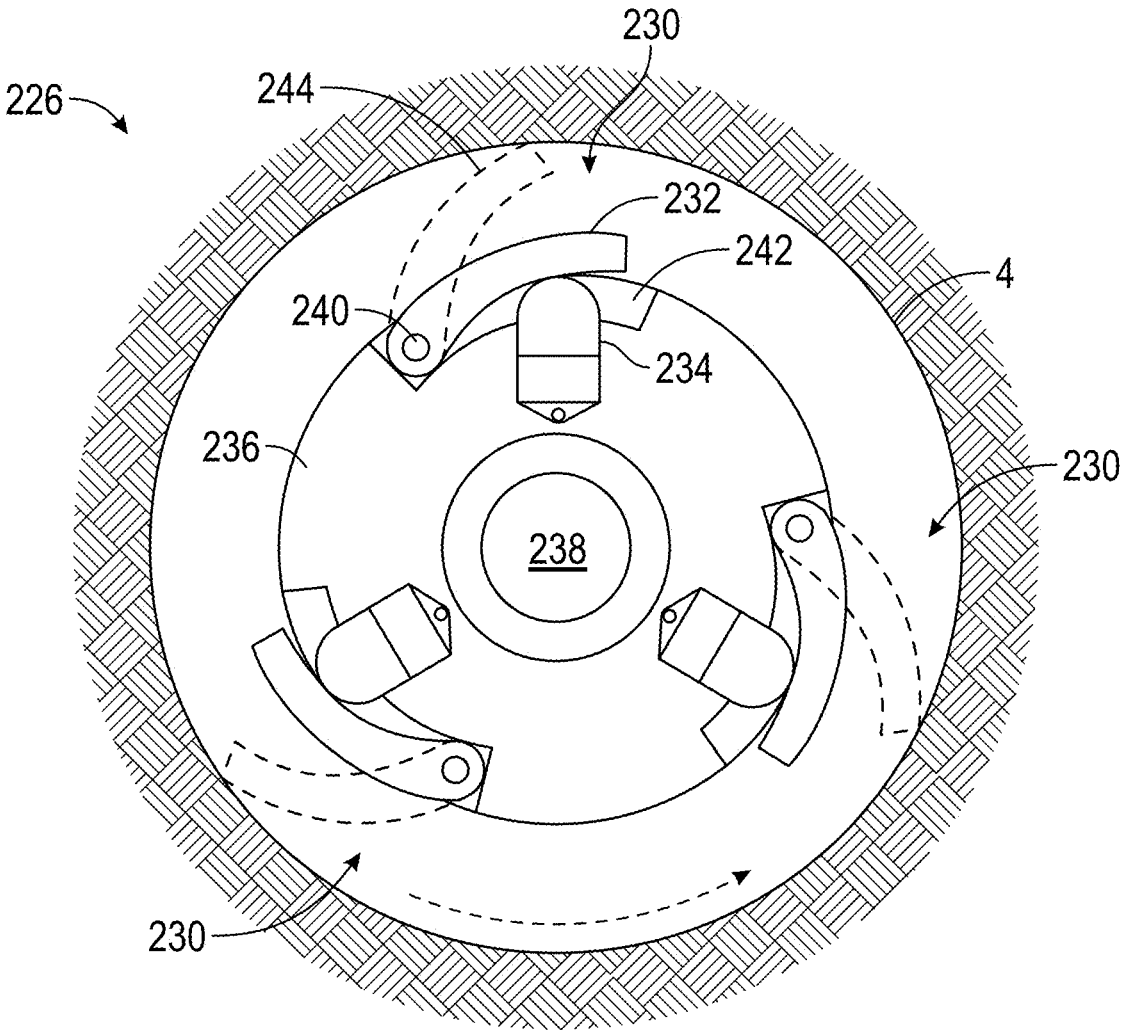
FIG. 2 is a radial cross-sectional schematic view of a rotary steerable tool in accordance with one or more embodiments.

Referring to FIG. 2, the actuator section 226 of the rotary steerable tool 200 is shown in a radial cross-sectional schematic view within the wellbore 4. The actuator section 226 includes a plurality of extendable members 230 for selectively pushing against the wall of the wellbore 4. The extendable members 230, in accordance with the present disclosure, may include a pad 232 and/or a piston 234 to push against the wall of the wellbore 4 and urge the drill bit 10 in a direction. A rotary steerable tool 200 within the scope of the present disclosure may alternatively include other types of extendable members 230 or mechanisms, in addition or in alternative to the pads 232, including but not limited to pistons configured to push against the wellbore 4 wall directly without visually distinct or separate pads.

The rotary steerable tool 200 includes a tool body 236 and a flowbore 238 through which pressurized drilling fluid flows. As shown, the pads 232 are in a fully-retracted position, close to the tool body 236, and are movable over a range of movement defined between the shown fully-retracted position and a fully-extended position 244, as further described below. Generally, the pads 232 may be radially moveable with respect to the tool body 236 either by linear translation of the pads 232 or by pivoting the pads 232. In the illustrated example, the pads 232 are pivotably coupled to the tool body 236 about hinges 240, and are thereby pivotable between the retracted and extended positions. In the extended position, the pads 232 pivot outward and move radially closer to the wellbore 4. Optionally, the tool body 236 also includes recesses 242, which receive the pads 232 when pivoted inward in the fully-retracted position. Optionally, the piston 234 of each extendable member 230 may be selectively actuated to forcibly extend and/or retract the pistons 234. Thus, as further described below, the pistons 234 may be controlled to urge the pads 232 radially outwardly in a coordinated manner to control the direction of drilling.

An "extended position" may refer to any position where the pad 232 is extended outwardly beyond the fully-retracted position, and not necessarily fully extended. In use, the desired rate of steering may be achieved without fully-extending the pads 232, although for a given mode of use, and all other parameters being held constant (e.g. constant formation composition, steady rate of rotation of the drill string, etc.), increasing extension or extension force of the pads against the wellbore wall will tend to increase the rate of steering as the drill bit is pushed in the opposite direction. In particular, the pads 232 push the drill bit 10 into the opposing wellbore wall to create a reaction force at the drill bit 10 that then increases the wellbore wall penetration in the direction of the drill bit reaction force. The rate of steering may for example be measured in the amount of deflection of the borehole trajectory for a given length of drilling. Similarly, "extension" or "extending" refers to movement of the pad 232 outwardly from its current position, toward but not necessarily all the way to a fully extended position. Conversely, "retraction" or "retracting" refers to the pad 232 moving radially inward. As the pad 232 pivots inwardly the pad 232 may not necessarily move all the way to the fully retracted position.

A rotary steerable tool according to the present disclosure may include any number of pads 232, but typically includes a plurality of pads circumferentially spaced about the tool body 236. Although not strictly required, the pads are preferably evenly-spaced circumferentially. As shown in the example of FIG. 2, the rotary steerable tool 200 may include three pads 232 evenly spaced 120 degrees apart around the circumference of the rotary steerable tool 200.

Figure 3:
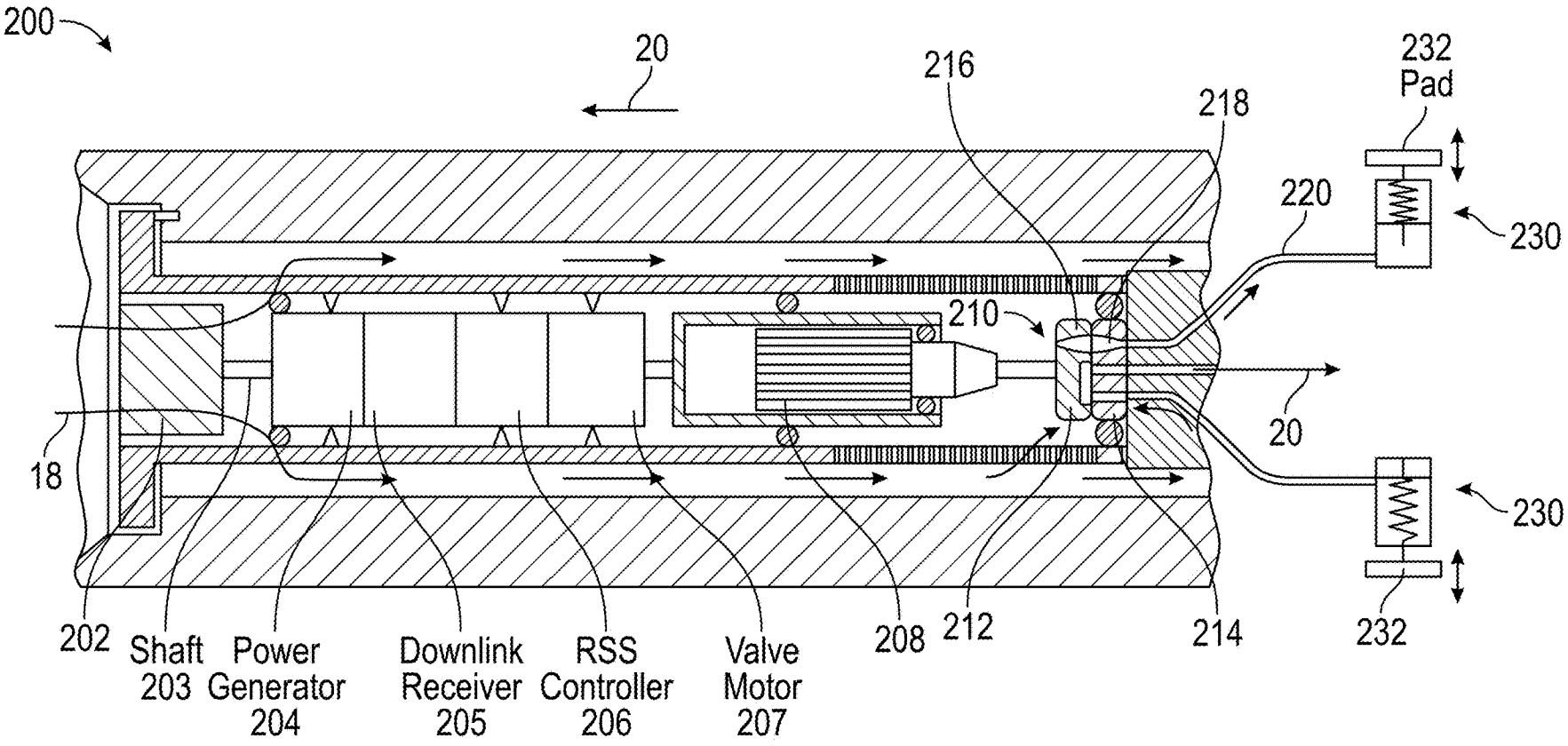
FIG. 3 is a cross-sectional schematic view of a portion of a rotary steerable tool in accordance with one or more embodiments.

Referring to FIGS. 1-3, during drilling operations, drilling fluid from the path 18 is used to selectively engage the pistons 234 of the extendable members 230 and to push the pads 232 against the wall of the wellbore 4. The resultant force of all of the extended pads 232 defines the steering direction of the drill bit 10. However, because the actuator section 226 is rotating with the drill bit 10 and/or the tool string 2, the extendable members 230 are sequentially extended and retracted to maintain a consistent resultant force direction (e.g. steering direction during an operating mode). To achieve the desired sequence of extending and retracting the extendable members 230, the valve 210 is used.

Referring to FIG. 3, a portion of the rotary steerable tool 200 is shown in cross-section with a rotary type valve used as the valve 210. The flowbore 238 (FIG. 2) is in fluid communication with the downhole motor 202, and the downhole motor 202 rotates in response to the drilling fluid passing therethrough along the path 18. The downhole motor 202 is coupled to the power generator 204 and electrical power is generated to operate the downlink receiver 205, the RSS controller 206, and a valve motor 207. The downlink receiver 205 is in electrical communication with the RSS controller, and as described further herein, the downlink receiver 205 is operable to receive data signals from the surface equipment of the directional drilling system 100. Once the downlink receiver 205 receives a data signal, the RSS controller 206 can selectively control the operation of the valve motor 207 (herein the "operational parameters"). For example, the RSS controller 206 may control the valve motor 207 on/off, set the rotational direction, the speed of rotation, and/or the duration of operation. Additionally, the operational parameters may also include patterns of rotation (e.g., rotate counter clockwise for 10-sec while making full revolutions and then oscillate between clockwise and counter clockwise rotations for 15-sec while making only partial revolutions.) Optionally, the operational parameters may be programmed into the RSS controller 206 at the surface, and/or the operational parameters may be set according to the data signal received by the downlink receiver 205 while downhole.

Referring still to FIG. 3, the valve motor 207 is rotationally coupled with a splined shaft 208 to a rotary actuator 212. The valve 210 comprises the rotary actuator 212 and a valve seat 214 that remains stationary with respect to the tool body 236 of the actuator section 226 (FIG. 2). Thus when the valve motor 207 rotates the rotary actuator 212, there is a relative rotation difference between the rotary actuator 212 and the valve seat 214. The rotary actuator 212 further comprises a port 216 that is in fluid communication with the drilling fluid of the path 18. The valve seat 214 further comprises a port 218 which is in fluid communication with a flow path 220 and one of the extendable members 230. While the cross-sectional view of FIG. 3 only shows one port 218, it should be appreciated that the number of ports 218 will coincide with the number of extendable members 230. Additional ports (shown but not numbered) may also be provided in both the rotary actuator 212 and the valve seat 214 to provide intermittent fluid communication between each of the extendable members 230 and the path 20 downhole of the rotary steerable tool 200.

During operation of the valve motor 207, the rotary actuator 212 rotates relative to the valve seat 214, and the relative rotation positions the port 216 into intermittent alignment with each port 218 of the valve seat. When the ports 216, 218 are aligned, the high pressure drilling fluid from path 18 is sequentially provided to each of the extendable members 230. Concurrently with the ports 216, 218 alignment, the additional ports in the valve seat 214 align with the additional ports in the rotary actuator 212, the extendable members 230 connected to the additional ports retract, and the drilling fluid flows along the path 20.

Referring again to FIG. 1, during drilling operations, pressure pulses of the drilling fluid may be used to communicate signals within the directional drilling system 100. As described herein, the communication of pressure pulse signals may alternatively be referred to as "mud pulse telemetry" or "mud pulse signals". The attributes of the mud pulse signal comprise an amplitude, a frequency, and a duration, and any attribute may indicate or transfer relevant information. For example, the amplitude could relate to a first variable, the frequency could relate to a second variable, and the duration could relate to yet a third variable. Additionally, combinations or patterns of mud pulse signals could relate to fourth or even additional variables. The mud pulse signals may be passed as pressure pulses within the flowbore 238 of the tool string 2 or within the annulus 22. Generally speaking, mud pulse signals that are passed downhole are referred to as "downlink signals", while mud pulse signals that are passed from the downhole positions to the surface are referred to as "uplink signals". Additionally, an "acknowledgment signal" is a particular type of uplink signal which is sent to confirm the receipt of a downlink signal.

In particular, the surface control unit 40 connected to a surface transmitter 46 can be used to send downlink signals to the downhole components (e.g., the LWD/MWD tool 30 and/or the rotary steerable tool 200) of the tool string 2. An uplink receiver 48 can be used to receive uplink signals from the downhole components. Similarly, the LWD/MWD tool 30 can receive the downlink signals and can send uplink signals with the telemetry module 32. However, the rotary steerable tool 200 may only have one-way data communication ability, such that the rotary steerable tool 200 can receive downlink signals, but may not be able to send uplink signals. Optionally, the rotary steerable tool 200 may not be electrically or communicatively connected with the telemetry module 32 of the LWD/MWD tool 30, so relaying (e.g., transferring) uplink signals from the rotary steerable tool 200 to the LWD/MWD tool 30 may also not be possible. Thus the rotary steerable tool 200 may be configured to operate in particular patterns (described further herein as "acknowledgment actions" or "detectable acknowledgment actions") to compensate for the rotary steerable tool 200 inability to send uplink signals.

In an example, an uplink signal can be sent by momentarily restricting the drilling fluid flow within the tool string 2 (e.g., via the telemetry module 32 of the LWD/MWD tool 30). The restriction could be provided by valves within the telemetry module 32 that temporarily blocks or restricts the drilling fluid flow along the path 18 within the flowbore 238. The momentary restriction causes a pressure increase, or a positive pulse, when the fluid along the path 18 impacts the point of restriction. The positive pulse flows back up the drilling fluid in the flowbore 238, and is received by the uplink receiver 48 (typically a pressure transducer) at the surface. Alternatively, an uplink signal can also be sent as a negative pulse by increase the flowrate through the tool string 2, for example by venting some of the drilling fluid of the path 18 into the annulus 22. The pressure drop of the drilling fluid of the path 18, thus creates a negative pressure wave that travels to the uplink receiver 48.

Similarly, a downlink signal may be produced by creating pressure pulses in the drilling fluid at the surface of the directional drilling system 100. In an example, the pressure pulses may be produced by adjusting the flowrate of the pump 14 (e.g., by a variable speed pump 14 or by cycling the pump 14 between on and off). Alternatively, a variable flow restriction orifice (not shown) could be used downstream of the pump 14 to selectively provide and restrict the drilling fluid flow along the path 18. Alternatively, pressure pulses may be produced by diverting some of the drilling fluid flow around the tool string 2, thus flowing from the pump 14 to the retention pit 24. To divert the drilling fluid flow from the pump 14, the directional drilling system 100 may further include a supply line 52 between the pump 14 and the stand pipe 16, a return line 54 between the annulus 22 and the retention pit 24, and a bypass line 56 between the lines 52, 54. By momentarily, diverting some of the drilling fluid flow along the bypass line 56, a pressure drop or a negative pressure pulse is produced that is transmitted along the path 18 and down the tool string 2. The negative pulse is detected downhole by the LWD/MWD tool 30 and/or the rotary steerable tool 200. In the example of FIG. 1, the bypass line 56 is part of the surface transmitter 46, and the bypass line 56 includes a choke valve 58 and a flow restricting orifice 60. The choke valve 58 is operatively controlled by the surface control unit 40 via a manifold 62 and a choke valve actuator 64. To send a downlink signal, the surface control unit 40 sends a signal to the manifold 62 that engages the choke valve actuator 64. The choke valve actuator 64 fully opens or partially opens the choke valve 58 and allows the drilling fluid to flow along the bypass line 56. The flow restricting orifice 60 further regulates the flowrate along the bypass line 56.

By using the mud pulse telemetry, the uplink signals and downlink signals can optionally communicate analogue signals or binary signals. The LWD/MWD tool 30 and/or the rotary steerable tool 200 may be programmed at the surface to correlate the uplink signals and downlink signals with particular commands. Alternatively, the LWD/MWD tool 30 and/or the rotary steerable tool 200 may also adjust the uplink and downlink signal programming while downhole in the wellbore 4.

In the example of an analogue uplink signal monitored by the uplink receiver 48, the uplink receiver 48 may continuously monitor the pressure of the supply line 52. The changes in pressure with respect to time may thus communicate the uplink signal as an analogue signal. Similarly, for a binary uplink signal, the uplink receiver 48 may again continuously monitor the pressure of the supply line 52, and may simply count a series of sequentially pressure pulses that depart from the steady state or "baseline" pressure. For example, pressure pulses at a higher pressure than the baseline pressure may indicate a binary 1 value, while pressure pulses at a lower pressure than the baseline pressure may indicate a binary 0 value (or vice versa). Each pressure pulse thus represents a bit of data and a sequential series or "sting of bits" may thus communicate the uplink or downlink signal. In the case of downlink signals, the string of bits correlates to particular commands programmed within the LWD/MWD tool 30 and/or the rotary steerable tool 200. In the case of uplink signals, the sting of bits is interpreted by users at the surface.

Optionally, error detection may also be used with binary uplink and downlink signals to ensure the full signal was received and that the signal was not corrupted and/or misinterpreted. One such error detection method is the use of a "parity bit" or "check bit" which is added to the uplink or downlink signal upon transmission and is then checked for the proper parity upon receiving the signal. The parity bit is a 1 or a 0 valve, which can be added at any position within the string of bits, and in this example the parity bit is added to the end of the string of bits. The programming of the LWD/MWD tool 30 and/or the rotary steerable tool 200, and the users of the uplink receiver 48 and the surface control unit 40 select a common parity setting (either an "even parity" or an "odd parity"). An even parity is established when a summation of the string of bits including the parity bit is an even number. An odd parity is established when a summation of the string of bits including the parity bit is an odd number. Thus by setting a common parity, the sending components for the uplink and downlink signals set the signal to that common parity upon transmission by adding either a 1 or a 0, depending on what is needed to achieve the common parity. Then when the uplink or downlink signal is received, the parity is calculated and is confirmed against the previously programmed common parity setting (e.g., when the downlink transmission is received with correct parity setting). If the received signal's parity is not correct, the received signal was corrupted and/or misinterpreted, and should be sent again. However, by this step of the method, only the receiving device detects the signal transmission error, and thus the sending device still needs to be alerted of the signal transmission error and triggered to retransmit the signal. For example, in the case of a downlink command to the rotary steerable tool 200, the alerting of the transmission error could be an uplink command of the error or could be the absence of an uplink signal (e.g., absence of an acknowledgement signal) as described further below. Additionally, other types of error detection are contemplated such as cyclic redundancy check (CRC) and check sum. For cyclic redundancy check, a sequence of redundant bits, called cyclic redundancy check bits, are appended to the end of a downlink command so that the resulting data unit becomes exactly divisible by a second, predetermined binary number. Then at the receiver, such as the rotary steerable tool 200, the downlink signal is divided by the predetermined binary number. If there is no remainder, the downlink signal is considered to be correct and is therefore accepted by the rotary steerable tool 200. Similarly, with checksum error detection, the downlink command may be divided into segments of bits, the segments of bits are added using binary addition complement arithmetic) to calculate a so called "check SUM" which is transmitted along with the downlink signal. Upon receipt of the downlink signal, such as by the rotary steerable tool 200, the downlink signal is again processed to calculate a second "check sum" which is the confirmed against the first check sum of the downlink command. If the first and second check sums are equal, the downlink signal is considered to be correct and is therefore accepted by the rotary steerable tool 200.

Additionally, with or without error detection, a confirmation that a downlink signal was received is desirable so that the users of the directional drilling system 100 have some confirmation that the rotary steerable tool 200 is operating correctly. However, the rotary steerable tool 200 may only have one-way data communication ability such that the rotary steerable tool 200 can receive downlink signals but may not be able to send uplink signals. Thus the rotary steerable tool 200 may be configured to operate in particular patterns (e.g., operate with an "acknowledgment action" or "acknowledgment event" during an "acknowledgment mode") when a downlink signal is successfully received. In an example, the acknowledgment action includes temporarily suspending the steering operations of the rotary steerable tool 200, while the drill bit 10 continues rotating. As the steering is temporarily suspended, the weight on the drilling string 2 may be reduced, the drill bit 10 may be lifted off the bottom of the wellbore 4, or the drilling of the wellbore 4 may simply continue without steering. More particularly, the steering of the rotary steerable tool 200 is suspended by holding the valve motor 207 and the valve 210 stationary relative to the rotary steerable tool 200 to stop the sequential operation of the extendable members 230. The position of the valve 210 may be arbitrary or may be at a selected stationary position. Also, the position of the valve 210 may energize the piston 234 of none, one, or more than one of the extendable members 230. During the acknowledgment action, the downhole motor 202 and the power generator 204 may continue to operate and the rotational speed of the tool string 2 may also remain substantially unchanged. In a further example, the acknowledgment action includes temporarily disengaging (e.g., switching off operation) of the valve motor 207 of the rotary steerable tool 200 while the drill bit 10 continues rotating. When the valve motor 207 is disengaged the valve 210 may or may not remain stationary and a pressure drop may result across (e.g. upstream vs downstream) the power generator 204. When the valve motor 207 is disengaged, less power is drawn from the power generator 204, thus the power generator 204 may tend to increase in rotational speed because there is less torque needed to rotate the power generator 204 shaft. Hence a pressure or acoustic sensor on the surface (such as within the uplink receiver 48) or in the MWD/LWD tool 30 could detect the drop in and subsequent increase in pressure or sound when the valve motor 207 disengages as the acknowledgement signal. Additionally, an electric field, magnetic field or electromagnetic field sensor on the MWD/LWD tool 30 could also be used to detect changes in the valve motor 207 operation, such as when the valve motor 207 disengages as the acknowledgement signal, or when the valve motor 207 increases in operational speed as an alternative acknowledgement signal.

The acknowledgment action of the rotary steerable tool 200 may be detected by many different methods and sensor types. The detection of the acknowledgment action can be performed by equipment at the surface of the directional drilling system (e.g., by the uplink receiver 48), may be detected by the LWD/MWD tool 30 and then transmitted with the telemetry module 32 to the surface control unit 40, or may be detected with a combination of both the surface equipment and the LWD/MWD tool 30.

Figure 4:
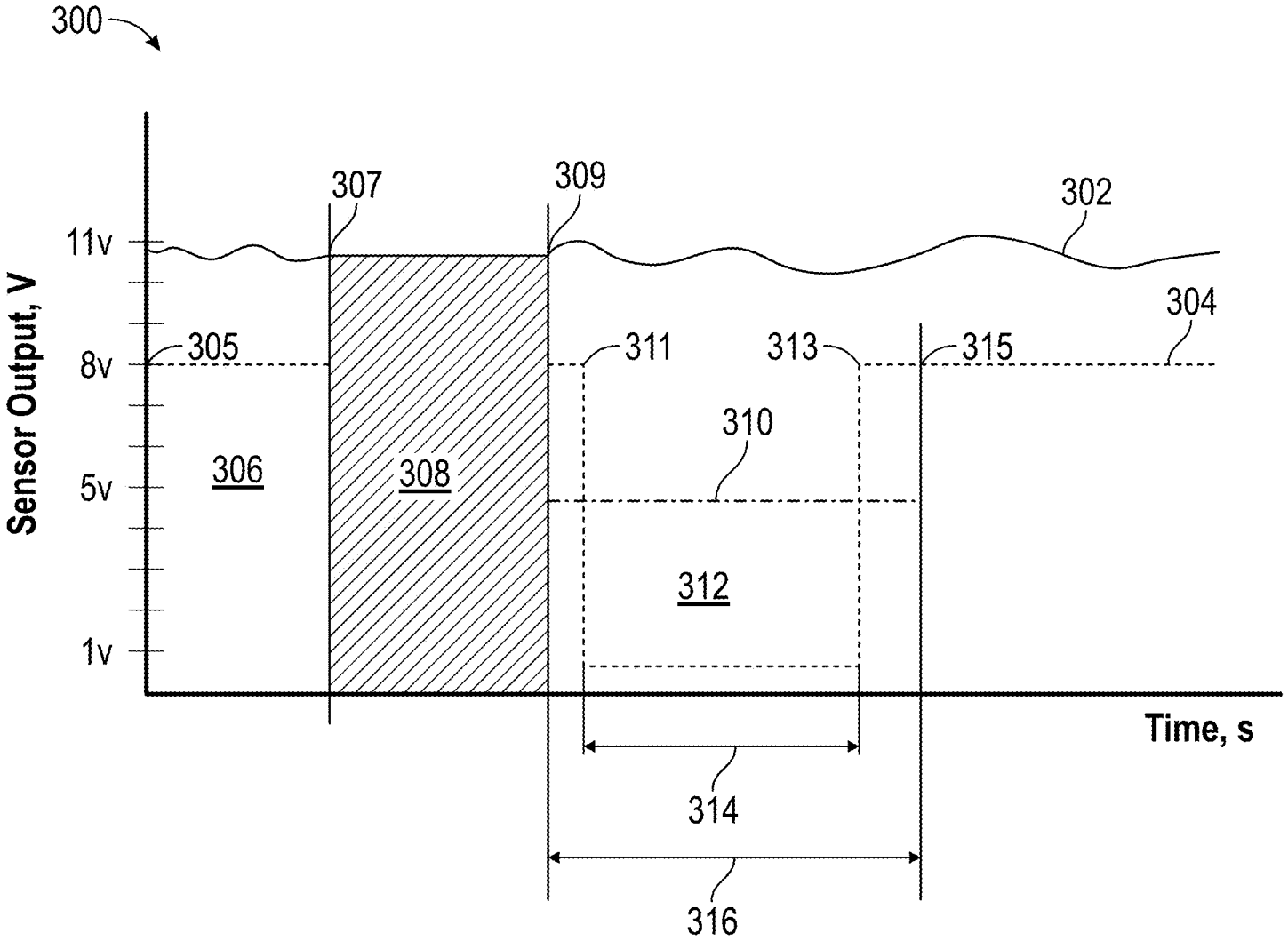
FIG. 4 is an example sensor output diagram measuring a rotary speed of the tool string and an acknowledgement action of the rotary steerable tool in accordance with one or more embodiments.

Referring to FIG. 4, an example sensor output diagram 300 is shown measuring an acknowledgement action of the rotary steerable tool 200. In this example both the uplink receiver 48 and the LWD/MWD tool 30 are used to detect the acknowledgement action. The sensor 34 on the LWD/MWD tool 30 is measuring a baseline rotary speed signal 302 that represents the total rotational speed of the drill bit 10. Additionally, the uplink receiver 48 is measuring a RSS signal 304 that in this example is a pressure within the flowbore 238 of the wellbore 4. To overlay the baseline rotary speed signal 302 and the RSS signal 304, FIG. 4 uses common units for each signal such that the vertical axis has the units of voltage and the horizontal time axis has the units of time (e.g., such as seconds). However, it should be appreciated that the baseline rotary speed signal 302 can be converted to revolutions and the RSS signal 304 can be converted to pressure per square inch.

Referring to FIGS. 3 and 4, a position 305 is shown where the RSS signal 304 has a voltage of approximately 8 v and defines a RSS baseline emission 306. A component of the pressure measured by the RSS signal 304 is due to the operation of the valve motor 207, the valve 210, and the sequential operation of the extendable members 230. At a position 307 a downlink transmission 308 begins and transfers downlink steering commands to the rotary steerable tool 200. The downlink transmission 308 ends at a position 309. The downlink transmission 308 was successfully received and thus the rotary steerable tool 200 begins an acknowledgement action to communicate the downlink receipt. If the downlink signal was not received, the acknowledgement action would not begin. Similarly, if the downlink signal was corrupted, as determined by an error detection method as described above, again the acknowledgement action would not begin. Here, the downlink signal was successfully received without errors so the acknowledgement action begins at a position 311. The RSS signal 304 is reduced to approximately 1 volt and crosses a threshold 310 of approximately 5 volts. The threshold 310 is a value set within the receiver of the RSS signal 304, which in this example is the uplink receiver 48. RSS signals 304 that fall below the threshold 310 are thus understood by the uplink receiver 48 to have potentially originated from an acknowledgement action of the rotary steerable tool 200. The magnitude of the threshold 310 may be adjustably set to reduce false indications of an acknowledgement action, for example as triggered by fluctuations in the RSS signal 304. It should be appreciated that at during the acknowledgement action of the rotary steerable tool 200, the steering operations of the drill bit 10 are temporarily suspended, but the drilling of the wellbore 4 may nevertheless continue. The downhole motor 202 and the power generator 204 continue to operate, and as shown after the position 311 in FIG. 4, the baseline rotary speed signal 302 also remains unchanged aside from normal fluctuations. In the example of FIG. 4, during the acknowledgement action, the RSS signal 304 remains at approximately 1 volt until a position 313. A RSS low emission 312 is thus established between the positions 311, 313. Additionally, a RSS signal dwell time 314 is established between the positions 311, 313 and represents the period of time that the steering operations of the rotary steerable tool 200 are suspended during the acknowledgement action. At the position 313, the RSS signal 304 returns to approximately 8 v as the valve motor 207, the valve 210, and the sequential operation of the extendable members 230 resumes. Alternatively, the acknowledgement action may increase at least one of the rate of the valve motor 207, the valve 210, or the sequential operation of the extendable members 230. In this manner, rather than temporarily suspending steering operations, the steering operations of the drill bit 10 may be temporarily disrupted as the drilling of the wellbore 4 continues. By increasing the operational rate of at least one of the valve motor 207, the valve 210, or the sequential operation of the extendable members 230, the RSS low emission 312 may shift to a level above the RSS baseline emission 306 level. The shifted and higher RSS low emission 312 may be detectable by the sensors of the LWD/MWD tool 30 and/or the uplink receiver 48. For example, as the extendable members 230 act out of proper timing with the rotation of the tool string 2, additional vibration and acoustic outputs may result. In addition, an increased operation of the valve 210 may also introduce additional vibration and acoustic outputs. Still further, an increased operation of the valve motor 207 may also create additional electric and/or electromagnetic outputs that could be detected by the sensors of the LWD/MWD tool 30. Such increase in emissions may also be detected as an increase in the pressure drop across the downhole motor 202 and power generator 204 as the rotary steerable tool 200 consumes more power to affect this higher emission from the baseline.

As described, the operation of the rotary steerable tool 200 is temporarily suspended during the RSS signal dwell time 314 as the acknowledgement action is performed, and while the other systems and components of the directional drilling system 100 remain in constant operation. However, a parameter of the various systems and components of the directional drilling system 100 may alternatively be adjusted so that the acknowledgement action is more reliably detected. Further, the same or a different parameter of the systems and components of the directional drilling system 100 may additionally or alternatively also be adjusted during the downlink transmission 308 so the downlink is transferred more reliably. For example, the adjusted parameter may include the speed of the pump 14, the rotational speed imparted to the tool string 2 from the derrick 12, the rotational speed of the downhole motor 202, and/or the downward force on the drill bit 10 may each or individually be increased or decrease. By adjusting the systems and components of the directional drilling system 100 in this manner, less "background noise" may result. As used herein, the term "background noise" shall be interpreted broadly and understood to include acoustic noise, variations in pressure, vibration, variation in a sensor output, a change in frequency, magnetic, electromagnetic, etc. Overall, by having less background noise from the directional drilling system 100, the reliability may be increase for the downlink transmission 308 and then for the monitoring of the RSS low emission 312 during the acknowledgment action of the rotary steerable tool 200. For example, the LWD/MWD tool 30 may pause mud pulsing when it detects a downlink signal intended for the rotary steerable tool 200. The pause of mud pulsing may be set for at least the duration of the RSS signal dwell time 314 to ensure adequate time to monitor the RSS low emission 312 of the acknowledgment action.

Referring still to FIG. 4, the systems and components of the directional drilling system 100 may also be adjusted to reduce the background noise before the position 307. For example, the drill bit 10 may be lifted off the bottom of the wellbore 4 to reduce noise and vibration emissions from the drill bit 10 and wellbore 4 interactions. The downlink transmission 308 may then be transmitted more reliably, and the RSS low emission 312 may also be detected more reliability. Thus, it is anticipated that the amount of variation in the RSS signal 304 may also be reduced when the background noise is reduced, thus further increasing the detection reliability of the RSS low emission 312. It is also anticipated that the systems and components of the directional drilling system 100 may use different operating conditions during the downlink transmission 308 and the RSS low emission 312.

With or without reducing the background noise, the uplink receiver 48 or other sensor used to measure the RSS signal 304 may also have a "listening mode" where the uplink receiver 48 is configured to detect the RSS low emission 312 over a particular or predetermined time interval.

Referring again to FIG. 4, at the position 309 the downlink transmission 308 is complete and thus the uplink receiver 48 may enter the listening mode and begin monitoring the RSS signal 304 for the RSS low emission 312. The period of time for the listening mode is shown as a RSS signal detection window 316, that begins at the position 309 and ends at a position 315. The duration of the RSS signal dwell time 314 is a programmed value, and so the duration of the RSS signal detection window 316 can also be programmed into the uplink receiver 48. If the RSS low emission 312 is not detected during the RSS signal detection window 316, another downlink transmission 308 can be initiated. Further, if the RSS low emission 312 is not detected during the RSS signal detection window 316, the systems and components of the directional drilling system 100 may be adjusted to reduce the background noise as previously described.

The listening mode is described with respect to the uplink receiver 48, however the listening mode may alternatively be used when the LWD/MWD tool 30 monitors the RSS signal 304. When the LWD/MWD detects the RSS low emission 312, the telemetry module 32 of the LWD/MWD tool 30, transmits an acknowledgement signal ("ACK signal") to the surface via the uplink receiver 48 and/or the surface control unit 40. However, when the LWD/MWD tool 30 does not detect the RSS low emission 312, the telemetry module 34 of the LWD/MWD tool 30, transmits a no acknowledgement signal ("NACK signal") to the surface via the uplink receiver 48 and/or the surface control unit 40. When the NACK signal is received, another downlink transmission 308 can be initiated.

Figure 5:
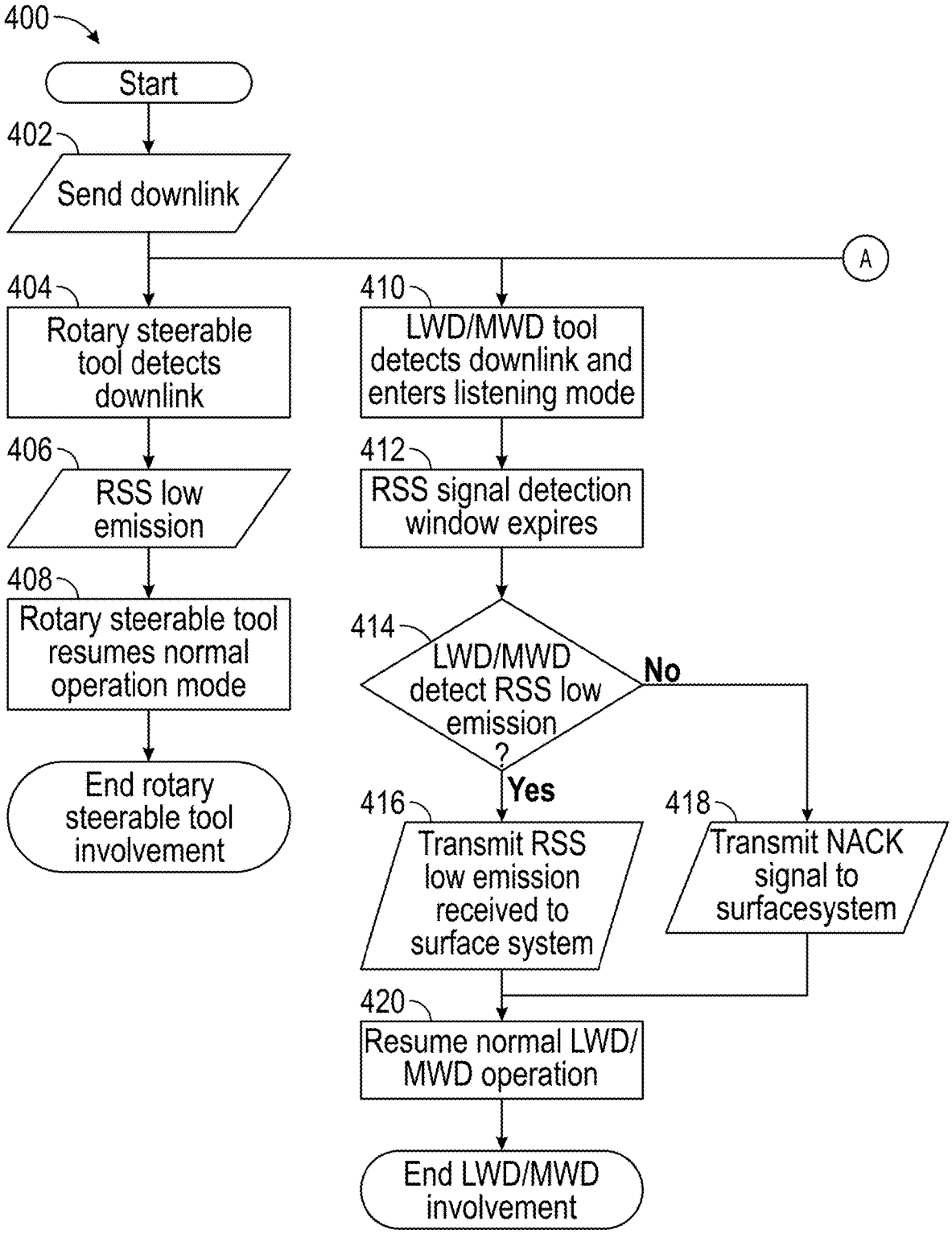
FIG. 5 is flowchart illustrating command logic for a downlink acknowledgement system in accordance with one or more embodiments.
Figure 5:
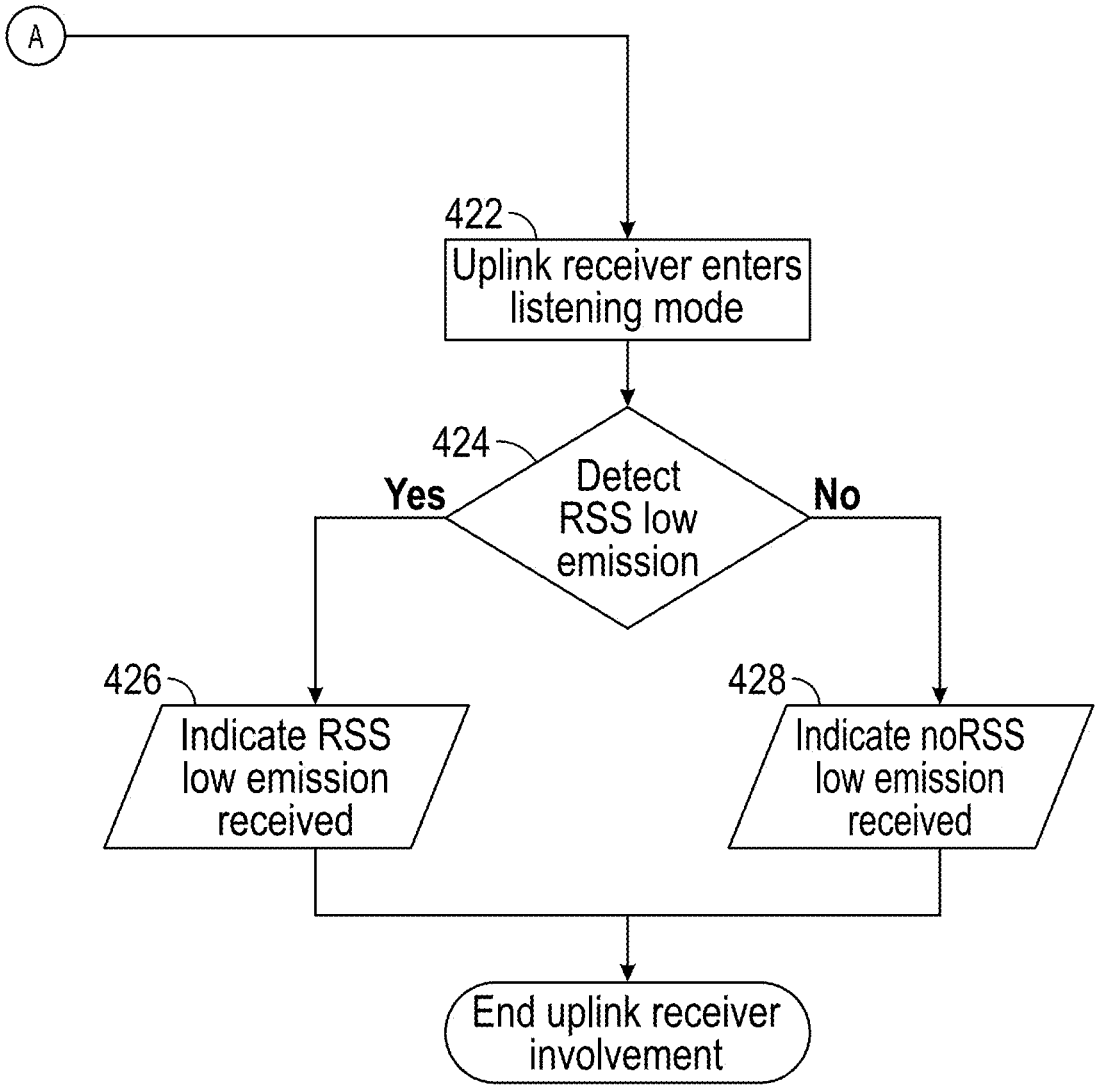

The flowchart 400 of FIG. 5 illustrates command logic for a downlink acknowledgement system in accordance with one or more embodiments. Each example includes combinations of features previously described and are not intended to be limiting.

Referring to FIGS. 4 and 5, in a block 402, the downlink transmission 308 is sent as is shown by the position 307. In a block 404, the rotary steerable tool 200 detects the downlink transmission 308 and then in a block 406 the rotary steerable tool 200 performs an acknowledgement action to produce the RSS low emission 312. Next in a block 408, the rotary steerable tool 200 resumes normal operation as is shown by the position 313.

Alternatively, after the downlink transmission 308 is sent in the block 402, the LWD/MWD tool 30 (FIG. 1) is used in a block 410 to detect the downlink transmission 308. Upon receiving the downlink transmission 308, the LWD/MWD tool 30 enters the listening mode and monitors for the RSS signal 304 during the RSS signal detection window 316. In a decision block 414, the LWD/MWD tool 30 determines if the RSS low emission 312 was detected within the RSS signal detection window 316. If the RSS low emission 312 was detected, the telemetry module 32 of the LWD/MWD tool 30 transmits a confirmation signal to the surface systems (e.g., the uplink receiver 48 and/or the surface control unit 40). Then the LWD/MWD tool 30 resumes normal operation in a block 420. Alternatively, if in the decision block 414, the RSS low emission 312 was not detected, the telemetry module 32 of the LWD/MWD tool transmits a NACK signal to the surface systems (e.g., the uplink receiver 48 and/or the surface control unit 40) in a block 418. Then the LWD/MWD tool 30 again resumes normal operation in the block 420.

Alternatively, after the downlink transmission 308 is sent in the block 402, the uplink receiver 48 enters the listening mode in a block 422 and monitors for the RSS signal 304 during the RSS signal detection window 316. In a decision block 424, the uplink receiver 48 determines if the RSS low emission 312 was detected within the RSS signal detection window 316. If the RSS low emission 312 was detected, the uplink receiver 48 indicates a confirmation in a block 426. Alternatively, if in the decision block 424, the RSS low emission 312 was not detected, the uplink receiver 48 indicates that no RSS low emission 312 was detected.

While this disclosure primarily discusses downlink signals which are transmitted via mud pulse telemetry within the drilling fluid, other methods of sending downlink signals are contemplated and within the scope of this disclosure. For example, the downlink signals may be an electromagnetic signal transmitted via the tool string 2, an acoustic signal transmitted via the tool string 2 and/or via ground contact proximate to the wellbore 4. Additionally, a downlink signal may be sent by imparting a series of rotations to the tool string 2 by the derrick 12 and/or by the downhole motor 202. For example, the rotary speed, direction of rotation, and combinations thereof can send a downlink signal. In addition, the weight applied to the tool string 2 and the time interval between particular events can also be used to create downlink signals, and may be used in combinations or patterns with the above disclosed methods of creating a downlink signal. For example, one downlink combination may include reducing the weight applied to the tool string 2, followed by ten seconds drill strong rotation, ten seconds of no rotation, and then a reapplication of weight to the tool string 2.

Additionally, the acknowledgement action may also be monitored or detected by other types of sensors at the surface or by other types of sensors 34 on the LWD/MWD tool 30. For example, when the acknowledgement action includes turning off the valve motor 207 and the valve 210, an audible change is measurable by the acoustic type sensors 34. Additionally, when the valve 210 is turned off, the extendable members 230 also cease sequential operation and have an audible change related to the changed contact with the wall of the wellbore 4. Additionally, the acknowledgement action may also be monitored by torque on the LWD/MWD tool 30 when the sensor 34 is a torque sensor. As the extendable members 230 push against the wall of the wellbore 4 during steering operations, a friction results which increases the torque along the LWD/MWD tool 30. In addition, even if one or two of the extendable members 230 remain extended and continue to drag on the wall of the wellbore 4, the torque profile measured by the sensor 34 is different than the torque profile with sequential operation of the extendable members 230, and thus the torque measurements of sensor 34 may still be used to detect the acknowledgement action.

Still further, the rotary steerable tool 200 may also be configured to perform actions, similar to the acknowledgment action, at set intervals during the drilling operations. As described herein, the set intervals of actions may be alternatively referred to as "heart beat signals". The heart beat signal would occur without first receiving a downlink signal and could be used to indicate continued proper operation of the rotary steerable tool 200. In an example, the heart beat signal could be produced by so called "rocking" of the valve 210, whereby the port 216 of the rotary actuator is alternated into alignment with a first port 218, then into alignment with a circumferentially adjacent second port 118, and then back into alignment with the first port 218.

In addition to the embodiments described above, many examples of specific combinations are within the scope of the disclosure, some of which are detailed below:

Embodiment 1. A rotary steerable tool operable to steer a drill bit for drilling a wellbore, the rotary steerable tool comprising:

- a downhole motor powered by a motive fluid;
- a power generator connectable to and powered by the downhole motor to produce electrical power;
- a valve motor powered by the electrical power and connectable with a valve, operation of which during an operating mode selectively directs the pressurized fluid to an extendable member that is radially movable for selectively engaging a wall of the wellbore to steer a drilling direction of the drill bit; and wherein the rotary steerable tool is operable in an acknowledgment mode to confirm receipt of a downlink transmission by performing a detectable acknowledgement action that continues to rotate the drill bit, but temporarily suspends the steering of the drill bit for a period of time by maintaining the valve motor in a stationary rotational position relative to the valve.

Embodiment 2. The rotary steerable tool of Embodiment 1, wherein the detectable acknowledgment action is detectable by a sensor operable to measure a RSS low emission from the acknowledgment action to confirm the downlink transmission.

Embodiment 3. The rotary steerable tool of claim 2, wherein the sensor is located on a logging-while-drilling measurement-while-drilling ("LWD/MWD") tool.

Embodiment 4. The rotary steerable tool of Embodiment 1, wherein the rotary steerable tool is connectable to a logging-while-drilling measurement-while-drilling ("LWD/MWD") tool that is not electrically connected or communicatively connected to the rotary steerable tool and wherein:

the LWD/MWD tool comprises a sensor, and the LWD/MWD tool is operative to send an uplink signal to at least one of an uplink receiver or a surface control unit to confirm detection of the RSS low emission.

Embodiment 5. The rotary steerable tool of Embodiment 1, wherein the period of time is set by the downlink transmission.

Embodiment 6. The rotary steerable tool of Embodiment 1, wherein the downlink transmission begins a listening mode for a predetermined time interval, and wherein an uplink receiver or a logging-while-drilling measurement-while-drilling ("LWD/MWD") tool monitors for the detectable acknowledgement action during the listening mode.

Embodiment 7. The rotary steerable tool of Embodiment 1, wherein the valve comprises a rotary valve.

Embodiment 8. The rotary steerable tool of claim 1, wherein:

the rotary steerable tool is set to a parity setting of an even parity or an odd parity;

the downlink transmission is a binary signal including a parity bit, which configures the downlink transmission to the parity setting of the rotary steerable tool; and the rotary steerable tool is operable to perform the detectable acknowledgement action when the downlink transmission is received with correct parity setting.

Embodiment 9. The rotary steerable tool of Embodiment 1, wherein at least one of a speed of the motive fluid, a rotational speed of the drill bit, or a downward force on the drill bit is adjusted to reduce a background noise and increase a reliability of receiving the downlink transmission.

Embodiment 10. The rotary steerable tool of Embodiment 9, wherein the background noise remains reduced for a predetermined time interval including a RSS signal detection window to increase the measurement reliability of the RSS low emission with the sensor.

Embodiment 11. A method of directionally drilling a wellbore, the method comprising:

flowing a fluid through a flowbore of a downhole motor of a rotary steerable system to rotate a power generator and produce electrical power;

powering a valve motor of the rotary steerable system with the electrical power;

operating a rotary valve with the valve motor to selectively direct the fluid to a plurality of extendable members that are radially movable to engage a wall of the wellbore;

radially moving at least one of the extendable members to engage the wall and steer a drilling direction of a drill bit;

transmitting a downlink transmission to the rotary steerable tool to steer a direction of the drill bit;

performing a detectable acknowledgement action with the rotary steerable tool in an acknowledgment mode to confirm receipt of the downlink transmission, wherein the detectable acknowledgement action rotates the drill bit while temporarily suspending the steering of the drill bit for a period of time by maintaining the valve motor in a stationary rotational position relative to the rotary valve; and detecting the detectable acknowledgement action with a sensor to confirm the downlink transmission was received.

Embodiment 12. The method of Embodiment 11, wherein detecting the acknowledgement event comprises measuring a RSS low emission from the detectable acknowledgement action.

Embodiment 13. The method of Embodiment 11, wherein:

the sensor is part of a logging-while-drilling measurement-while-drilling ("LWD/MWD") tool;

the LWD/MWD tool is not electrically connected or communicatively connected to the rotary steerable tool; and the method further comprises transmitting an uplink signal with the LWD/MWD tool to at least one of an uplink receiver or a surface control unit to confirm detection of the RSS low emission.

Embodiment 14. The method of claim 11, wherein the sensor is located on a logging-while-drilling measurement-while-drilling ("LWD/MWD") tool.

Embodiment 15. The method of Embodiment 11, further comprising setting the period of time with the downlink transmission.

Embodiment 16. The method of Embodiment 11, further comprising:

initiating a listening mode for an uplink receiver or a logging-while-drilling measurement-while-drilling ("LWD/MWD") tool, after transmitting of the downlink transmission;

defining a RSS signal detection window for a predetermined time interval; and monitoring measurements from the sensor during the RSS signal detection window.

Embodiment 17. The method of Embodiment 11, wherein the downlink transmission is a binary signal, the method further comprising:

programming the rotary steerable tool with a parity setting of an even parity or an odd parity;

adding a parity bit to the downlink transmission before the transmitting of the downlink transmission;

transmitting the downlink transmission including the parity bit;

confirming that the downlink transmission including the parity bit matches the parity setting of the rotary steerable tool; and performing the detectable acknowledgement action when the parity setting is matched.

Embodiment 18. The method of Embodiment 11, further comprising adjusting at least one of a speed of the fluid, a rotational speed of the drill bit, and a downward force on the drill bit to reduce a background noise and increase a reliability of receiving the downlink transmission.

Embodiment 19. The method of Embodiment 18, wherein the background noise remains reduced for a predetermined time interval including a RSS signal detection window to increase the measurement reliability of the RSS low emission by the sensor.

Embodiment 20. A directional drilling system for drilling a wellbore, the directional drilling system comprising:

a downhole motor powered by a motive fluid;

a rotary steerable tool including a power generator connectable to and powered by the downhole motor, to produce electrical power;

wherein a valve motor is powered by the electrical power and connectable with a rotary valve, operation of which can selectively direct the pressurized motive fluid to a plurality of extendable members that are radially movable for selectively engaging a wall of the wellbore to steer a drilling direction of a drill bit; and wherein the rotary steerable tool is operable in an acknowledgment mode to confirm receipt of a downlink transmission by performing a detectable acknowledgement action that continues to rotate the drill bit, but temporarily suspends the steering of the drill bit for a period of time by maintaining the valve motor in a stationary rotational position relative to the rotary valve.

Embodiment 21. The directional drilling system of Embodiment 20, further comprising:

a logging-while-drilling measurement-while-drilling ("LWD/MWD") tool that is not electrically connected or communicatively connected to the rotary steerable tool;

wherein the LWD/MWD tool comprises a sensor to measure a RSS low emission from the acknowledgment action; and wherein the LWD/MWD tool is operative to send an uplink signal to at least one of an uplink receiver and a surface control unit to confirm detection of the RSS low emission.

Embodiment 22. The directional drilling system of Embodiment 20, wherein the period of time is set by the downlink transmission.

Embodiment 23. A directional drilling system for drilling a wellbore, the directional drilling system comprising:

a downhole motor powered by a motive fluid;

a rotary steerable tool including a power generator connectable to and powered by the downhole motor, to produce electrical power;

a logging-while-drilling measurement-while-drilling ("LWD/MWD") tool that is not electrically connected or communicatively connected to the rotary steerable tool;

wherein a valve motor is powered by the electrical power and connectable with a rotary valve, operation of which can selectively direct the pressurized motive fluid to a plurality of extendable members that are radially movable for selectively engaging a wall of the wellbore to steer a drilling direction of a drill bit;

wherein the rotary steerable tool is operable in an acknowledgment mode to confirm receipt of a downlink transmission by performing a detectable acknowledgement action that continues to rotate the drill bit, but temporarily disengages the valve motor; and wherein a pressure sensor or an acoustic sensor positioned at the surface or in the LWD/MWD tool are operable to measure the acknowledgement action.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A rotary steerable tool operable to steer a drilling direction of a drill bit for drilling a wellbore, the rotary steerable tool comprising:

a downhole motor powered by a motive fluid;

a power generator connectable to and powered by the downhole motor to produce electrical power;

a valve motor powered by the electrical power and connectable with a valve, operation of which during an operating mode selectively directs a pressurized fluid to an extendable member that is radially movable for selectively engaging a wall of the wellbore to steer the drilling direction of the drill bit; and wherein the rotary steerable tool is operable in an acknowledgment mode to confirm receipt of a downlink transmission by performing a detectable acknowledgement action that continues to rotate the drill bit, but temporarily suspends the steering of the drill bit for a period of time by maintaining the valve motor in a stationary rotational position relative to the valve.

2. The rotary steerable tool of claim 1, wherein the detectable acknowledgment action is detectable by a sensor operable to measure a RSS low emission from the acknowledgment action to confirm the downlink transmission.

3. The rotary steerable tool of claim 2, wherein the sensor is located on a logging-while-drilling measurement-while-drilling ("LWD/MWD") tool.

4. The rotary steerable tool of claim 1, wherein the rotary steerable tool is connectable to a logging-while-drilling measurement-while-drilling ("LWD/MWD") tool that is not electrically connected or communicatively connected to the rotary steerable tool and wherein:

the LWD/MWD tool comprises a sensor, and the LWD/MWD tool is operative to send an uplink signal to at least one of an uplink receiver or a surface control unit to confirm detection of a RSS low emission.

5. The rotary steerable tool of claim 1, wherein the period of time is set by the downlink transmission.

6. The rotary steerable tool of claim 1, wherein the downlink transmission begins a listening mode for a predetermined time interval, and wherein an uplink receiver or a logging-while-drilling measurement-while-drilling ("LWD/MWD") tool monitors for the detectable acknowledgement action during the listening mode.

7. The rotary steerable tool of claim 1, wherein the valve comprises a rotary valve.

8. The rotary steerable tool of claim 1, wherein:

the rotary steerable tool is set to a parity setting of an even parity or an odd parity;

the downlink transmission is a binary signal including a parity bit, which configures the downlink transmission to the parity setting of the rotary steerable tool; and the rotary steerable tool is operable to perform the detectable acknowledgement action when the downlink transmission is received with correct parity setting.

9. The rotary steerable tool of claim 1, wherein at least one of a speed of the motive fluid, a rotational speed of the drill bit, or a downward force on the drill bit is adjusted to reduce a background noise and increase a reliability of receiving the downlink transmission.

10. The rotary steerable tool of claim 9, wherein the background noise remains reduced for a predetermined time interval including a RSS signal detection window to increase the measurement reliability of a RSS low emission with a sensor.

11. A method of directionally drilling a wellbore, the method comprising:

flowing a fluid through a flowbore of a downhole motor of a rotary steerable tool to rotate a power generator and produce electrical power;

powering a valve motor of the rotary steerable tool with the electrical power;

operating a rotary valve of the rotary steerable tool with the valve motor to selectively direct the fluid to a plurality of extendable members that are radially movable to engage a wall of the wellbore;

radially moving at least one of the extendable members to engage the wall and steer a drilling direction of a drill bit;

transmitting a downlink transmission to the rotary steerable tool to steer the drilling direction of the drill bit;

performing a detectable acknowledgement action with the rotary steerable tool in an acknowledgment mode to confirm receipt of the downlink transmission, wherein the detectable acknowledgement action rotates the drill bit while temporarily suspending the steering of the drilling direction of the drill bit for a period of time by maintaining the valve motor in a stationary rotational position relative to the rotary valve; and detecting the detectable acknowledgement action with a sensor to confirm the downlink transmission was received.

12. The method of claim 11, wherein detecting the acknowledgement action comprises measuring a RSS low emission from the detectable acknowledgement action.

13. The method of claim 11, wherein:

the sensor is part of a logging-while-drilling measurement-while-drilling ("LWD/MWD") tool;

the LWD/MWD tool is not electrically connected or communicatively connected to the rotary steerable tool; and the method further comprises transmitting an uplink signal with the LWD/MWD tool to at least one of an uplink receiver or a surface control unit to confirm detection of a RSS low emission.

14. The method of claim 11, wherein the sensor is located on a logging-while-drilling measurement-while-drilling ("LWD/MWD") tool.

15. The method of claim 11, further comprising setting the period of time with the downlink transmission.

16. The method of claim 11, further comprising:

initiating a listening mode for an uplink receiver or a logging-while-drilling measurement-while-drilling ("LWD/MWD") tool, after transmitting of the downlink transmission;

defining a RSS signal detection window for a predetermined time interval; and monitoring measurements from the sensor during the RSS signal detection window.

17. The method of claim 11, wherein the downlink transmission is a binary signal, the method further comprising:

programming the rotary steerable tool with a parity setting of an even parity or an odd parity;

adding a parity bit to the downlink transmission before the transmitting of the downlink transmission;

transmitting the downlink transmission including the parity bit;

confirming that the downlink transmission including the parity bit matches the parity setting of the rotary steerable tool; and performing the detectable acknowledgement action when the parity setting is matched.

18. The method of claim 11, further comprising adjusting at least one of a speed of the fluid, a rotational speed of the drill bit, and a downward force on the drill bit to reduce a background noise and increase a reliability of receiving the downlink transmission.

19. The method of claim 18, wherein the background noise remains reduced for a predetermined time interval including a RSS signal detection window to increase the measurement reliability of a RSS low emission by the sensor.

20. A directional drilling system for drilling a wellbore, the directional drilling system comprising:

a downhole motor powered by a motive fluid;

a rotary steerable tool including a power generator connectable to and powered by the downhole motor, to produce electrical power;

wherein a valve motor is powered by the electrical power and connectable with a rotary valve, operation of which can selectively direct a pressurized motive fluid to a plurality of extendable members that are radially movable for selectively engaging a wall of the wellbore to steer a drilling direction of a drill bit; and wherein the rotary steerable tool is operable in an acknowledgment mode to confirm receipt of a downlink transmission by performing a detectable acknowledgement action that continues to rotate the drill bit, but temperarily suspends the steering of the drill bit for a period of time by maintaining the valve motor in a stationary rotational position relative to the rotary valve.

21. The directional drilling system of claim 20, further comprising:

a logging-while-drilling measurement-while-drilling ("LWD/MWD") tool that is not electrically connected or communicatively connected to the rotary steerable tool;

wherein the LWD/MWD tool comprises a sensor to measure a RSS low emission from the acknowledgment action; and wherein the LWD/MWD tool is operative to send an uplink signal to at least one of an uplink receiver and a surface control unit to confirm detection of the RSS low emission.

22. The directional drilling system of claim 20, wherein the period of time is set by the downlink transmission.

23. A directional drilling system for drilling a wellbore, the directional drilling system comprising:

a downhole motor powered by a pressurized motive fluid;

a rotary steerable tool including a power generator connectable to and powered by the downhole motor, to produce electrical power;

a logging-while-drilling measurement-while-drilling ("LWD/MWD") tool that is not electrically connected or communicatively connected to the rotary steerable tool;

wherein a valve motor is powered by the electrical power and connectable with a rotary valve, operation of which can selectively direct the pressurized motive fluid to a plurality of extendable members that are radially movable for selectively engaging a wall of the wellbore to steer a drilling direction of a drill bit;

wherein the rotary steerable tool is operable in an acknowledgment mode to confirm receipt of a downlink transmission by performing a detectable acknowledgement action that continues to rotate the drill bit, but temporarily disengages the valve motor; and wherein a pressure sensor or an acoustic sensor positioned at a surface or in the LWD/MWD tool are operable to measure the acknowledgement action.

* * * * *